US008302254B2

(12) United States Patent
Schuetz et al.

(10) Patent No.: US 8,302,254 B2
(45) Date of Patent: Nov. 6, 2012

(54) DIRT-COLLECTING DEVICE FOR A FLOOR-CLEANING MACHINE, AND FLOOR-CLEANING MACHINE HAVING SUCH A DIRT-COLLECTING DEVICE

(75) Inventors: Michael Schuetz, Stuttgart (DE); Florian Kolbeck, Gundelsheim (DE); Ruwantha De Silva, Schwieberdingen (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 23 days.

(21) Appl. No.: 12/657,293

(22) Filed: Jan. 15, 2010

(65) Prior Publication Data

US 2010/0180397 A1 Jul. 22, 2010

Related U.S. Application Data

(63) Continuation of application No. PCT/EP2008/005008, filed on Jun. 20, 2008.

(30) Foreign Application Priority Data

Jul. 18, 2007 (DE) ..... 10 2007 034 702

(51) Int. Cl.
*A47L 9/02* (2006.01)
*A47L 5/00* (2006.01)
*A47L 9/06* (2006.01)

(52) U.S. Cl. ..... 15/422.1; 15/401

(58) Field of Classification Search ..... 15/422.1, 15/401, 245
See application file for complete search history.

(56) References Cited

U.S. PATENT DOCUMENTS

| | | | | |
|---|---|---|---|---|
| 3,065,490 | A * | 11/1962 | Arones | 15/359 |
| 3,939,518 | A * | 2/1976 | Whitney et al. | 15/98 |
| 5,377,382 | A * | 1/1995 | Bores et al. | 15/340.1 |
| 5,579,555 | A * | 12/1996 | Pearse | 15/320 |
| 5,933,911 | A | 8/1999 | Windmeisser | |
| 6,895,633 | B2 * | 5/2005 | Tucker | 15/401 |
| 2003/0233729 | A1 | 12/2003 | Tucker | |
| 2006/0143855 | A9 * | 7/2006 | Legatt et al. | 15/401 |

FOREIGN PATENT DOCUMENTS

| | | | |
|---|---|---|---|
| DE | 20109267 | U1 * | 9/2001 |
| DE | 201 09 267 | | 10/2001 |
| FR | 2 740 023 | | 4/1997 |
| FR | 2740023 | A1 * | 4/1997 |
| RU | 48 259 | | 10/2005 |
| WO | 98/27856 | | 7/1998 |

* cited by examiner

*Primary Examiner* — Bryan R Muller
(74) *Attorney, Agent, or Firm* — Lipsitz & McAllister, LLC

(57) ABSTRACT

The invention relates to a dirt-collecting device for a floor-cleaning machine, for picking up a liquid from a floor surface which is to be cleaned, having a carrier and at least one wiping member for wiping the floor surface, the carrier and the at least one wiping member bounding a suction channel which opens out into a suction mouth and of which the free cross-sectional area, through which a suction stream can pass, decreases, at least in one channel portion, in a direction away from the suction mouth. In order to produce such a dirt-collecting device in a more cost-effective manner, it is proposed according to the invention that the suction channel has disposed in it at least one channel-narrowing member, which is produced separately from the carrier. The invention also relates to a floor-cleaning machine having such a dirt-collecting device.

19 Claims, 3 Drawing Sheets

DIRT-COLLECTING DEVICE FOR A FLOOR-CLEANING MACHINE, AND FLOOR-CLEANING MACHINE HAVING SUCH A DIRT-COLLECTING DEVICE

This application is a continuation of international application number PCT/EP2008/005008 filed on Jun. 20, 2008.

The present disclosure relates to the subject matter disclosed in international application number PCT/EP2008/005008 of Jun. 20, 2008 and German application number 10 2007 034 702.4 of Jul. 18, 2007, which are incorporated herein by reference in their entirety and for all purposes.

BACKGROUND OF THE INVENTION

The invention relates to a dirt-collecting device for a floor-cleaning machine, for picking up a liquid from a floor surface which is to be cleaned, having a carrier and at least one wiping member for wiping the floor surface, the carrier and the at least one wiping member forming boundaries of a suction channel which opens out into a suction mouth and of which the free cross-sectional area, through which a suction stream can pass, decreases, at least in one channel portion, in a direction away from the suction mouth.

The invention also relates to a floor-cleaning machine comprising at least one dirt-collecting device.

Floor-cleaning machines typically comprise a cleaning device with cleaning elements such as, for example, rotating brush rollers or plate brushes, which can be used to detach dirt from the floor surface which is to be cleaned. The operation of detaching dirt is assisted by the floor surface being subjected to the action of a cleaning liquid, for example water. By means of the dirt-collecting device mentioned in the introduction, the dirty liquid, i.e. the mixture of the cleaning liquid and the detached dirt, so-called dirt liquor, can be picked up from the floor surface by being sucked up. For this purpose, the floor-cleaning machine has a suction unit which is connected to the dirt-collecting device, so that it is possible to generate, within the suction channel, a suction stream, under the action of which the dirty liquid can be transferred from the suction channel, via the suction mouth and a suction line connecting with the suction mouth, into a dirty-liquid tank of the floor-cleaning machine. The at least one wiping member and the carrier form boundaries of the suction channel. For the purpose of delimiting the suction channel, it is additionally possible to use at least one boundary wall which preferably has a flexible configuration and need not necessarily come into contact with the floor surface.

In the case where the suction channel of the dirt-collecting device has a constant cross-sectional area over its entire length, the speed of the suction stream flowing through the suction channel decreases as the distance from the suction mouth increases. This makes it more and more difficult for liquid to be picked up as the distance from the suction mouth increases. In order, nevertheless, to achieve the situation where the liquid which is to be picked up can be picked up effectively over the entire length of the suction channel, U.S. Pat. No. 3,065,490 proposes a dirt-collecting device in which the free cross-sectional area of the suction channel, through which the suction stream can pass, decreases in a direction away from the suction mouth. The decrease in the free cross-sectional area results in an increase in the speed of the suction stream, so that the liquid can be sucked up effectively over the entire length of the suction stream.

In the case of the dirt-collecting device according to U.S. Pat. No. 3,065,490, the free cross-sectional area of the suction channel is decreased in that the portion of the carrier which bounds the suction channel is curved in a complicated manner along the suction channel. This requires costly production of the carrier by means of a complex production method.

It is an object of the present invention to provide a dirt-collecting device of the type in question and a floor-cleaning machine of the type in question which can both be produced in a more cost-effective manner.

SUMMARY OF THE INVENTION

This object is achieved according to the invention, in the case of a dirt-collecting device of the type mentioned in the introduction, in that the suction channel has disposed in it at least one channel-narrowing member, which is produced separately from the carrier.

By means of the at least one channel-narrowing member, which is disposed in the suction channel, the free cross-sectional area of the suction channel is decreased at least along one channel portion. According to the invention, the channel-narrowing member is produced separately from the carrier, i.e. it is not produced in the same working step as the carrier. This makes it possible for the methods which are necessary for producing the carrier and the at least one channel-narrowing member to be optimized separately from one another, in respect of the purpose of the carrier and of the at least one channel-narrowing member. In order to achieve lower production costs for the dirt-collecting device, it may be provided, for example, that the carrier and the at least one channel-narrowing member are produced by means of different production methods and/or from different materials. The selection of the production method and of the material for the carrier and for the at least one channel-narrowing member can be made here, for example, taking into account the costs for producing the dirt-collecting device as a whole and the function which is to be performed in each case by the carrier and the at least one channel-narrowing member.

It may be provided that the free cross-sectional area of the suction channel is decreased along the entire length of the suction channel by means of the at least one channel-narrowing member. It is also possible, however, for the free cross-sectional area of the suction channel to be decreased by means of the at least one channel-narrowing member in certain portions of the suction channel only. In particular, the dirt-collecting device may have a plurality of channel-narrowing members which decrease the free cross-sectional area in certain portions of the suction channel.

It is advantageous if the free cross-sectional area of the suction channel is adapted to be decreased by means of the at least one channel-narrowing member alone. This makes it possible to give the carrier a straightforward configuration, in particular a uniform configuration. The change in the free cross-sectional area of the suction channel along the suction channel is achieved then by means of the at least one channel-narrowing member alone.

The carrier preferably comprises a portion which bounds the suction channel and has a constant cross-section along the suction channel, at least outside the suction mouth. On the one hand, this allows a straightforward configuration of the carrier portion which bounds the suction channel and, on the other hand, it promotes the cost-effective production of the carrier as a whole. In particular, this embodiment allows the free cross-sectional area of the suction channel to be decreased by means of the at least one channel-narrowing member alone.

The carrier particularly advantageously has a constant cross-section along the suction channel, at least outside the suction mouth. This makes it easier to produce the carrier. Such a carrier may be provided, for example, in the form of a profile strip.

Particularly cost-effective production of the carrier can be achieved if the carrier is produced by a forming method, in particular by an extrusion method.

The carrier is preferably produced from metal. This allows, for example, processing and shaping by means of forming methods, in particular extrusion. In particular, the carrier may be produced from cost-effective and easy-to-process aluminum or an aluminum alloy. Furthermore, a carrier produced from metal has the advantage that it provides the dirt-collecting device with sufficient weight for the at least one wiping member, for the purpose of wiping the floor surface which is to be cleaned, to engage flush against the floor surface. There is thus no need for the dirt-collecting device to have force applied to it separately in order to allow the at least one wiping member to engage flush against the floor.

It is advantageous if the at least one channel-narrowing member is in the form of a plastics molding. This makes it possible to produce the at least one channel-narrowing member in a cost-effective manner. It may be produced, for example, by means of an injection-molding method, which allows the at least one channel-narrowing member to be provided cost-effectively with domed and curved surfaces, as may be provided for channeling the suction stream through the suction channel.

A straightforward and compact construction of the dirt-collecting device according to the invention is advantageously achieved in that the at least one channel-narrowing member is held on the carrier.

The carrier advantageously defines a guide for the at least one channel-narrowing member. This makes it easier to dispose the at least one channel-narrowing member in the suction channel and thus facilitates the assembly of the dirt-collecting device. The guide may be in the form, for example, of a groove which runs along the carrier and in which the at least one channel-narrowing member engages by means of a strip-like protrusion. Provision may also be made for the guide to be configured as a rib or protrusion around which the channel-narrowing member engages.

It is particularly advantageous if the guide is in the form of a dovetail guide. This allows the at least one channel-narrowing member to be easily introduced into the suction channel, and retained there, for assembly purposes.

It is preferable if the at least one channel-narrowing member is adapted to be connected in a releasable manner to the carrier. In the case of a dirt-collecting device formed in this way, use can be made, for example, of a plurality of channel-narrowing members which may be formed differently depending on the nature of the floor surface which is to be cleaned. Such a dirt-collecting device is highly versatile.

It has proven to be advantageous if the free cross-sectional area of the suction channel, through which the suction stream can pass, decreases continuously at least in certain portions along the suction channel by means of the at least one channel-narrowing member. It has been found that, with a continuous decrease in the free cross-sectional area of the suction channel, the suction stream suffers fewer flow losses. Moreover, this makes it possible to achieve a uniformly high flow speed of the suction stream and thus uniform transporting capability (dirt-collecting capacity) of the suction stream. An improved suction-extraction result can be achieved in this way.

The at least one channel-narrowing member advantageously at least partially delimits the free cross-sectional area of the suction channel, through which the suction stream can pass, by means of a surface portion, the distance of which from the suction-channel-bounding portion of the carrier, and/or of the at least one wiping member, increases in a direction away from the suction mouth. Since the distance of the surface portion from the suction-channel-bounding portion of the carrier, and/or of the at least one wiping member, increases, it is possible to decrease the free cross-sectional area of the suction channel in the direction away from the suction mouth. The suction stream can be channeled along the surface portion with a low level of flow losses. Channeling the suction stream is a particularly low-resistance operation if the distance of the surface portion from the suction-channel-bounding portion of the carrier, and/or of the at least one wiping member, increases continuously.

It has likewise proven to be advantageous in practice for the channeling of the suction stream if the at least one channel-narrowing member at least partially delimits the free cross-sectional area of the suction channel, through which the suction stream can pass, by means of a surface portion which is inclined relative to that portion of the carrier, and/or of the at least one wiping member, which bounds the suction channel.

It is preferred if that surface portion of the at least one channel-narrowing member which at least partially delimits the free cross-sectional area of the suction channel rises up from the floor surface which is to be cleaned, from the rear side of the device to the front side thereof, as seen in relation to the main movement direction of the floor-cleaning machine. This means that the surface portion is at a greater distance from the floor surface in the vicinity of the front side of the device than in the vicinity of the rear side of the device. If the dirt-collecting device has, on its front side, a wiping member which bounds the suction channel, this makes it possible for the wiping member, for the purpose of effective wiping of the floor surface, to bend over in the direction of the rear side of the dirt-collecting device.

The inclination of that surface portion of the at least one channel-narrowing member which at least partially delimits the free cross-sectional area of the suction channel advantageously changes in a direction away from the suction mouth relative to that portion of the carrier which bounds the suction channel and/or to the at least one wiping member. It has been found in practice that the suction stream can be channeled to particularly good effect in this way.

For the formation of an advantageously channeled suction stream, it has proven to be advantageous if the at least one channel-narrowing member at least partially delimits the free cross-sectional area of the suction channel, through which the suction stream can pass, by means of a surface portion which is curved convexly along the suction channel in the direction of the floor surface which is to be cleaned.

Improved channeling of the suction stream can be achieved in addition in that the at least one channel-narrowing member has a smooth surface on its side which bounds the free cross-sectional surface area of the suction channel, through which the suction stream can pass.

As has been mentioned in the introduction, the invention also relates to a floor-cleaning machine comprising at least one dirt-collecting device.

In the case of such a floor-cleaning machine, the object mentioned in the introduction is achieved according to the invention in that the at least one dirt-collecting device is formed in the manner described above.

The floor-cleaning machine according to the invention thus has the advantages which have already been mentioned in conjunction with the above explanations of the dirt-collecting device according to the invention.

The following description of preferred embodiments of the invention serves to give a more detailed explanation of the invention in conjunction with the drawings.

DETAILED DESCRIPTION OF THE INVENTION

Figure 1:
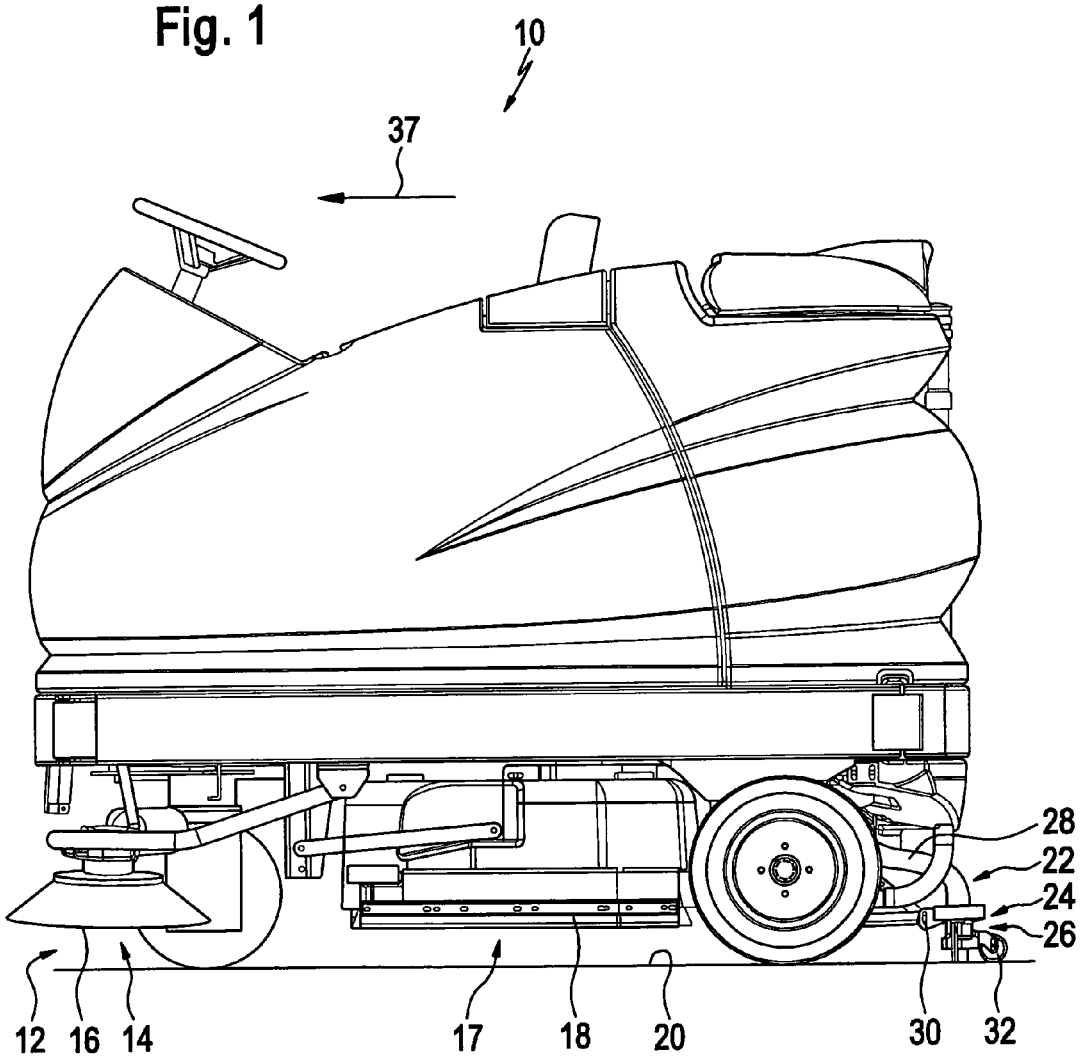
FIG. 1 shows a side view of a floor-cleaning machine according to the invention with a dirt-collecting device according to the invention.

A preferred embodiment of a floor-cleaning machine according to the invention is illustrated schematically in FIG. 1 and designated there by the reference numeral 10.

The floor-cleaning machine 10 carries, on its underside 12, a first cleaning device 14, which has a plate brush 16, and a second cleaning device 17, which has a floor-cleaning head 18 with two known brush rollers (not shown in the drawing). The plate brush 16 and the floor-cleaning head 18 are adapted to be lowered in a manner which is known per se, and will therefore not be explained, onto a floor surface 20 which is to be cleaned. In order to increase the cleaning action, cleaning liquid, preferably water, can be applied to the floor surface 20 for the purpose of freeing the latter of dirt.

For the purpose of picking up the dirty liquid, i.e. the mixture of the dirt and the cleaning liquid, the floor-cleaning machine 10 has, at its rear side 22, a preferred embodiment of a dirt-collecting device 24 according to the invention, which will be explained hereinbelow and is referred to hereinafter simply as suction bar 26.

By means of the suction bar 26, the liquid is sucked up from the floor surface 20. For this purpose, the floor-cleaning device 10 comprises a suction unit which is known per se, and is not shown in the drawing, is intended for generating negative pressure and is connected to the suction bar 26 via a suction line 28.

By means of a mounting device 30, which is known per se and will therefore not be explained in any more detail, the suction bar 26 is mounted in a movable manner on the floor-cleaning machine 10 such that it can be raised from the floor surface 20 and lowered onto the same. When the suction bar 26 is placed in position on the floor surface 20, a pair of rollers 32 and 34 disposed on the suction bar 26 can ensure a defined position of the suction bar 26 relative to the floor surface should this be necessary, for example in the case of uneven floors. If it is not desired to use the rollers 32, 34, for example on smooth, planar floors, the rollers 32, 34 can be swung upward.

Figure 2:
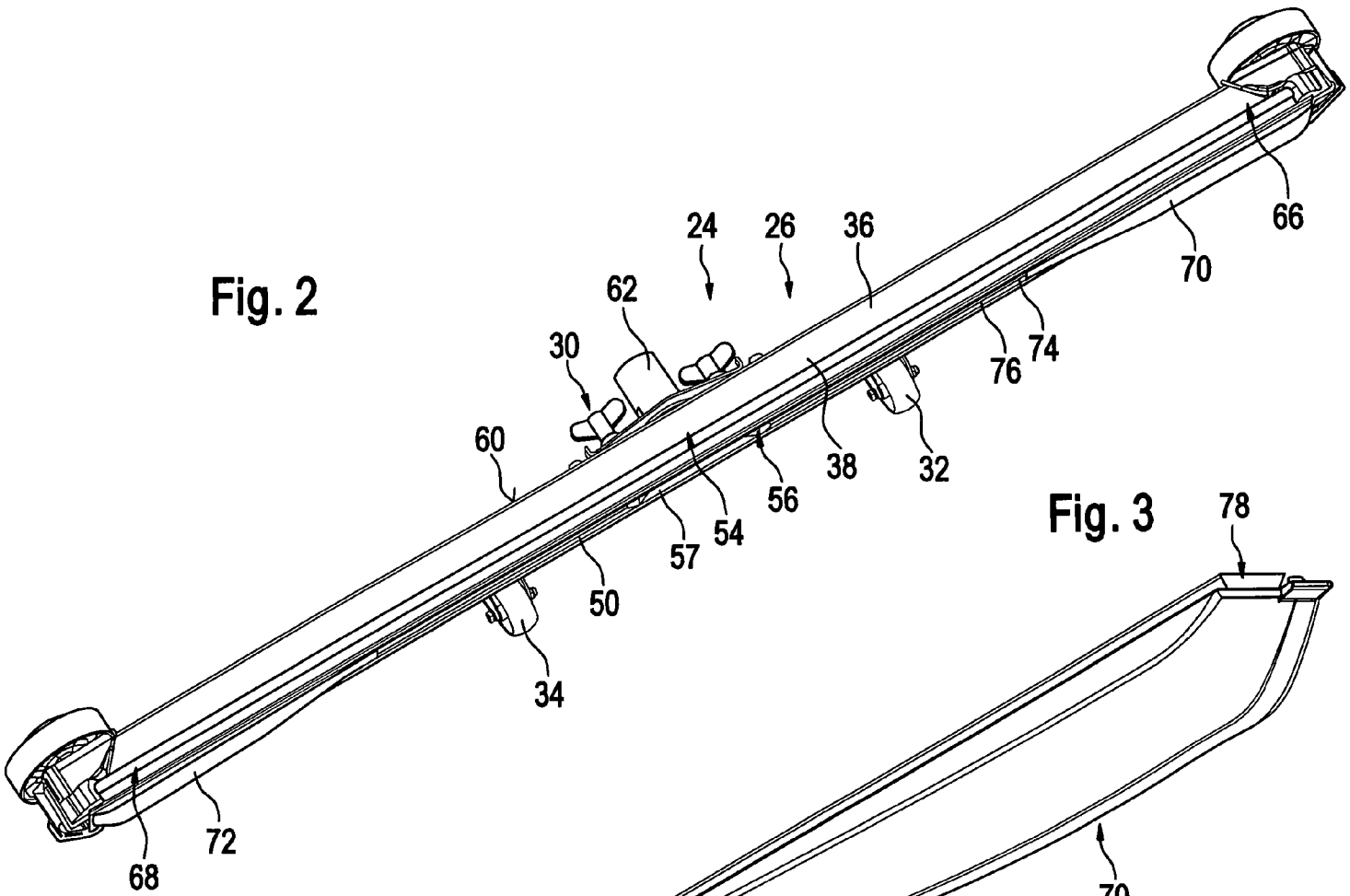
FIG. 2 shows a perspective view of the dirt-collecting device from FIG. 1 without any wiping members.

As is clear from FIG. 2 and the sectional illustrations of FIGS. 4 to 8, the suction bar 26 has a longitudinally extended rectilinear carrier 36. The latter is oriented transversely to a main movement direction 37 of the floor-cleaning machine 10.

In the case of a different preferred embodiment of a dirt-collecting device according to the invention, provision may be made for the carrier to be curved rather than rectilinear.

Figure 4:
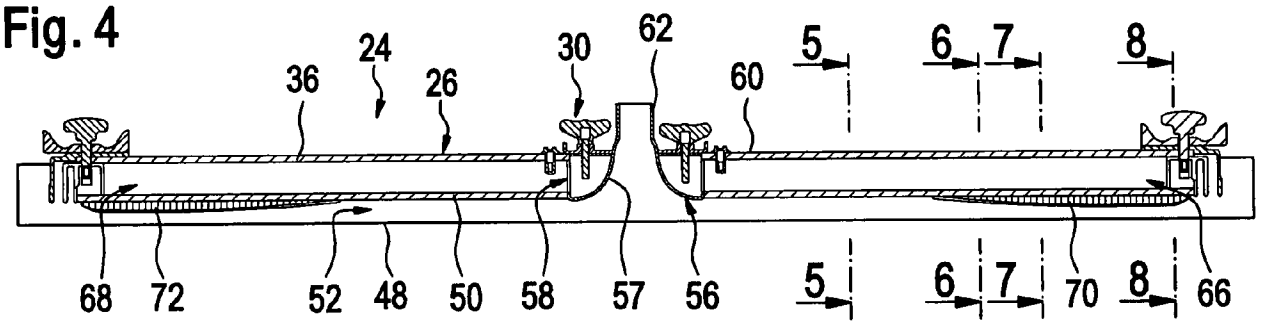
FIG. 4 shows a view in longitudinal section of the dirt-collecting device from FIG. 1.
Figure 8:
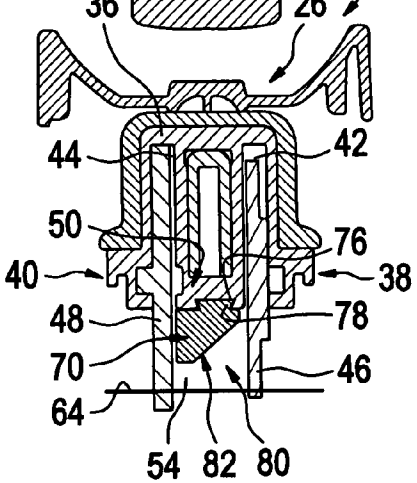
FIG. 8 shows a sectional view along line 8-8 in FIG. 4.
Figure 7:
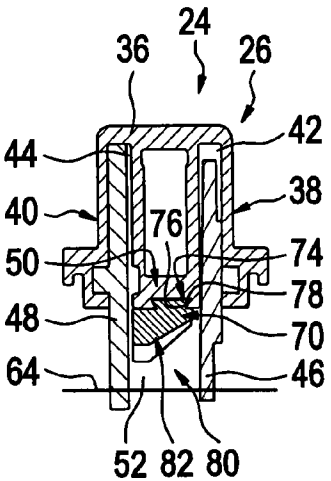
FIG. 7 shows a sectional view along line 7-7 in FIG. 4.
Figure 6:
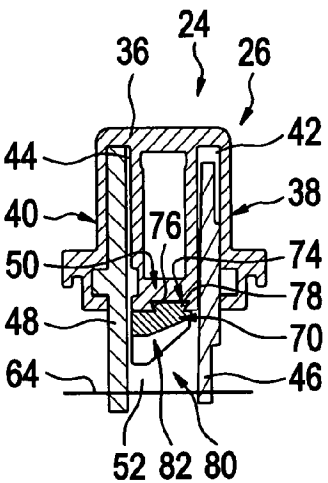
FIG. 6 shows a sectional view along line 6-6 in FIG. 4.
Figure 5:
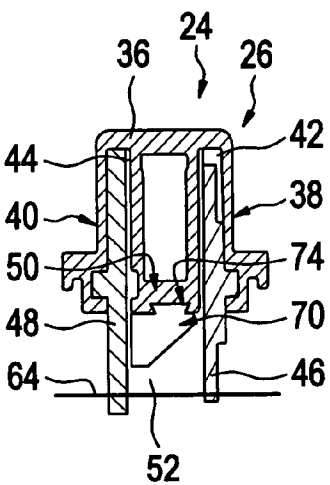
FIG. 5 shows a sectional view along line 5-5 in FIG. 4.

The carrier 36 has a front side 38, which is directed toward the floor-cleaning machine 10, and a rear side 40, which is directed away from the floor-cleaning machine 10. On the front side 38 and the rear side 40, the carrier 36 comprises slot-like recesses 42 and 44, extending in the longitudinal direction of the carrier 36, for a front wiping member 46 and a rear wiping member 48, respectively. FIG. 2 does not show the wiping members 46 and 48 and FIG. 4 shows only the rear wiping member 48.

The wiping members 46 and 48 and a lower wall portion 50 of the carrier 36 delimit a suction channel 52 which extends along the carrier 36 and opens out into a suction mouth 56 in the middle 54 of the carrier 36. Instead of the front wiping member 46, which is in contact with the ground, it would also be possible to use a preferably flexible boundary wall which, during operation of the floor-cleaning machine 10, defines a gap in relation to the floor, that is to say is not in contact with the floor. The boundary wall could likewise be held on the carrier 36.

The suction mouth 56 is formed as an opening of an insert part 57 which is configured as a hollow body and is disposed in a through-passage 58 in the middle 54 of the carrier 36, engaging through the latter. At its end opposite from the suction mouth 56, in the vicinity of the upper side 60 of the carrier 36, the insert part 57 has a tubular connector 62, to which the already mentioned suction line 28 is connected. This means that a flow connection between the suction channel 52 and the suction unit of the floor-cleaning machine 10 is formed through the suction mouth 56, the insert part 57 and the suction line 28.

Via the flow connection established, the dirty liquid can be sucked up from the floor surface 20 through the suction channel 52 by the suction unit. The wiping members 46 and 48 are used to wipe the dirty liquid from the floor surface 20 in order for it to be possible for this liquid to be sucked up effectively, so that the floor surface 20, following the cleaning operation, is cleaned and substantially dry.

In order that the dirty liquid can penetrate into the suction channel 52, the front wiping member 46 has a number of vertical slits which are not shown in the drawing, are known per se, and will therefore not be described in any more detail, and between which the liquid can pass into the suction channel 52.

The length of the wiping members 46 and 48 is dimensioned such that, when the suction bar 26 is placed in position on the floor surface 20, the wiping members can bend in a direction opposite to the direction of advance of the floor-cleaning machine 10. This is not shown in the drawing. The floor surface 20 can be wiped particularly effectively in this way.

The carrier 36 is produced from metal, in particular from aluminum, by means of a forming method, in particular of an extrusion method. This makes it possible to keep the production costs for the carrier 36 low. A further factor which is advantageous to the production costs of the carrier 36 is the fact that the cross-section thereof is constant along the suction channel 52, outside the suction mouth 56, because this makes it easier to produce the carrier 36 in the form of a profile part.

Figure 3:
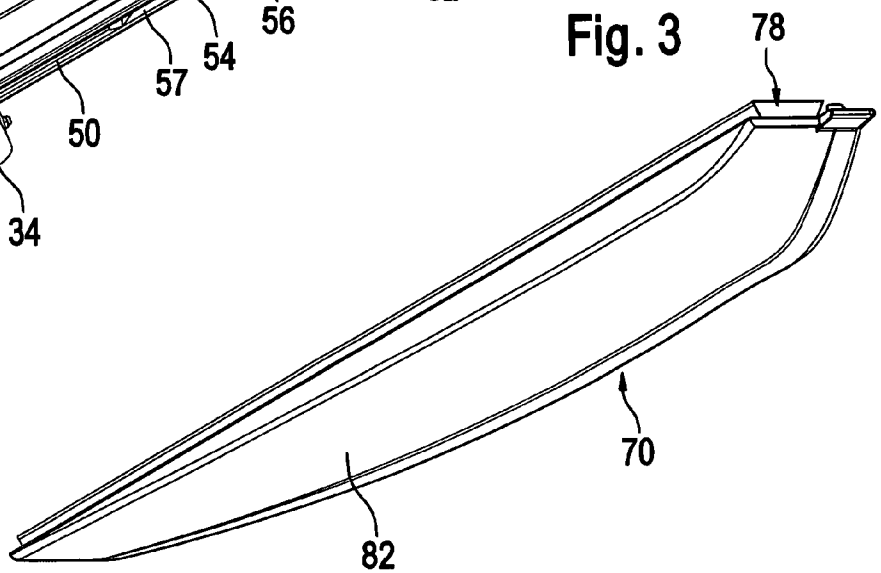
FIG. 3 shows an enlarged perspective view of a channel-narrowing member of the dirt-collecting device from FIG. 1.

At its outer end regions 66 and 68, these being directed away from the suction mouth 56, the suction bar 26 comprises a first channel-narrowing member 70 and a second channel-narrowing member 72, respectively, and these are disposed in the suction channel 52 and held on the carrier 36. The channel-narrowing members 70 and 72 are symmetrical to one another and perform the same functions. In order to make it easier to dispose the channel-narrowing members 70 and 72 in the suction channel 52, the carrier 36 has a guide 74, which is formed on the lower wall portion 50 of the carrier 36 in the form of a dovetail-like groove 76 extending along the carrier 36. The channel-narrowing members 70 and 72 each have a dovetail-like protrusion 78 corresponding to the dovetail-like groove 76 (FIG. 3, using the example of the first channel-narrowing member 70). This protrusion can be introduced into the groove 76 in order to retain the channel-narrowing members 70 and 72 on the carrier 36.

The channel-narrowing members 70 and 72 can be produced in a cost-effective manner from a plastics material, in particular by an injection-molding method. They are formed in the manner described hereinbelow such that the free cross-sectional area 80 (FIGS. 5 to 8), through which can pass a suction stream which flows through the suction channel 52, decreases along a respective channel portion in a direction away from the suction mouth 56. This makes it possible to compensate for a reduction in speed of the suction stream, which would be the case in the direction of the outer end regions 66 and 68 of the suction bar 26 in the absence of the channel-narrowing members 70 and 72.

By decreasing the free cross-sectional area 80 of the suction channel 52 at the end regions of the suction channel 52 which are directed away from the suction mouth 56, the channel-narrowing members 70 and 72 thus allow an increase in the speed of the suction stream. As a result, the liquid can be effectively sucked up over the entire length of the suction bar 26.

In order to allow particularly good channeling of the suction stream through the suction channel 52, it has proven to be advantageous if the channel-narrowing members 70 and 72 each have a surface portion 82 which delimits the free cross-sectional surface area 80 and the distance of which from the lower wall portion 50 of the carrier 36 increases in the direction away from the suction mouth 56. This can be seen, in particular, in FIGS. 5 to 8.

Furthermore, it has proven to be advantageous for the purpose of channeling the suction stream if the surface portion 82 is inclined relative to those portions of the wiping members 46 and 48 which delimit the suction channel 52 and relative to the lower wall portion 50 of the carrier 36, the inclination changing in the direction away from the suction mouth 56. The surface portion 82 is inclined such that the surface portion 82 rises up from the rear side 40 of the carrier 36 to the front side 38 thereof and from the floor surface 20 in the direction of the lower wall portion 50 of the carrier 36. The front wiping member 46 can thus be bent over, during operation of the floor-cleaning machine 10, such that it does not engage against the channel-narrowing member 70 and, furthermore, it is possible to achieve effective wiping of the floor surface 20 by means of the front wiping member 46.

The surface portion 82 of the channel-narrowing member 70, on account of the shaping described above, is curved convexly in the direction of the floor surface 20. As has been mentioned, this makes it possible to ensure channeling of the suction stream with a particularly low level of flow losses through the free cross-sectional area 80 of the suction channel 50. This channeling is assisted by the smooth surface of the surface portion 82.

Producing the carrier 36 separately from the channel-narrowing members 70 and 72 makes it possible to keep the production costs for the suction bar 26, and consequently also for the floor-cleaning machine 10, low. The production methods for the carrier 36 and the channel-narrowing members 70 and 72 can be optimized separately from one another in financial terms, but also in functional terms, with regard to the purposes of the carrier 36 and of the channel-narrowing members 70 and 72.

The production costs of the suction bar 26 and of the floor-cleaning machine 10 also benefit from the fact that the channel-narrowing members 70 and 72 can be connected to the carrier 36 without any tools being used. Provision may be made for the channel-narrowing members 70 and 72 to be able to be released from the carrier 36, and in particular to be releasable without any tools being used. This makes it possible, for example, to use different channel-narrowing members in the suction bar 26, depending on the floor surface 20 which is to be cleaned.

The invention claimed is:

1. Dirt-collecting device for a floor-cleaning machine, for picking up a liquid from a floor surface which is to be cleaned, comprising:

a carrier, at least one wiping member for wiping the floor surface, a suction channel which opens out into a suction mouth, the carrier and the at least one wiping member forming boundaries of the suction channel, a free cross-sectional area of the suction channel, through which a suction stream can pass, decreases, at least in one channel portion, in a direction away from the suction mouth, at least one channel-narrowing member disposed in the suction channel, the at least one channel-narrowing member being produced separately from the carrier, a surface portion of the at least one channel-narrowing member at least partially delimiting the free cross-sectional area of the suction channel, through which the suction stream can pass, an inclined surface portion of the surface portion being inclined relative to at least one of a channel-bounding portion of the carrier and a corresponding portion of the at least one wiping member, which bounds the suction channel, wherein:

the inclined surface portion slants continuously away from the channel-bounding portion of the carrier from a front side of the device toward a rear side of the device across a majority of the suction channel, and the surface portion of the at least one channel-narrowing member is at a smaller distance from the channel-bounding portion of the carrier in a vicinity of the front side of the device than in a vicinity of the rear side of the device.

2. The device according to claim 1, wherein:

the at least one channel-narrowing member comprises two channel-narrowing members, respectively arranged on either side of the suction mouth;

the free cross-sectional area of the suction channel is adapted to be decreased by only the two channel-narrowing members.

3. The device according to claim 1, wherein the channel-bounding portion of the carrier has a constant cross-section along the suction channel-outside a region of the suction mouth.

4. The device according to claim 3, wherein the carrier has a constant cross-section along the suction channel outside a region of the suction mouth.

5. The device according to claim 1, wherein the carrier is produced from aluminum or aluminum alloy by an extrusion forming method.

6. The device according to claim 1, wherein the carrier is produced from metal.

7. The device according to claim 1, wherein the at least one channel-narrowing member is produced from plastic by an injection molding process.

8. The device according to claim 1, wherein the at least one channel-narrowing member is held on the carrier.

9. The device according to claim 1, wherein the carrier defines a guide for the at least one channel-narrowing member.

10. The device according to claim 9, wherein the guide is in the form of a dovetail guide.

11. The device according to claim 1, wherein the at least one channel-narrowing member is adapted to be connected in a releasable manner to the carrier.

12. The device according to claim 1, wherein the free cross-sectional area of the suction channel, through which the suction stream can pass, decreases continuously at least in certain portions along the suction channel due to the at least one channel-narrowing member.

13. The device according to claim 1, wherein a distance of the surface portion of the at least one channel-narrowing member from at least one of the channel-bounding portion of the carrier and the corresponding portion of the at least one wiping member increases in a direction away from the suction mouth.

14. The device according to claim 1, wherein the inclination of the surface portion of the at least one channel-narrowing member changes in a direction away from the suction mouth relative to at least one of the channel-bounding portion of the carrier and the corresponding portion of the at least one wiping member.

15. The device according to claim 1, wherein the surface portion is curved convexly along the suction channel.

16. The device according to claim 1, wherein the at least one channel-narrowing member has a smooth surface on a side which bounds the free cross-sectional area of the suction channel.

17. The device according to claim 1, wherein the at least one channel-narrowing member carries a dovetail-like protrusion corresponding to a dovetail-like groove of the carrier such that the at least one channel-narrowing member is adapted to be connected and released from the carrier without use of any tools.

18. The device according to claim 1, wherein:

a first wiping member is arranged in a vicinity of the front side of the device; and a second wiping member is arranged in a vicinity of the rear side of the device.

19. Floor-cleaning machine, comprising:

at least one cleaning device; and at least one dirt-collecting device, the at least one dirt collecting device comprising:

a carrier, at least one wiping member for wiping the floor surface, a suction channel which opens out into a suction mouth, the carrier and the at least one wiping member forming boundaries of the suction channel, a free cross-sectional area of the suction channel, through which a suction stream can pass, decreases, at least in one channel portion, in a direction away from the suction mouth, at least one channel-narrowing member disposed in the suction channel, the at least one channel-narrowing member being produced separately from the carrier, a surface portion of the at least one channel-narrowing member at least partially delimiting the free cross-sectional area of the suction channel, through which the suction stream can pass, an inclined surface portion of the surface portion being inclined relative to at least one of a channel-bounding portion of the carrier and a corresponding portion of the at least one wiping member, which bounds the suction channel, wherein:

the inclined surface portion slants continuously away from the channel-bounding portion of the carrier from a front side of the device toward a rear side of the device across a majority of the suction channel, and the surface portion of the at least one channel-narrowing member is at a smaller distance from the channel-bounding portion of the carrier in a vicinity of the front side of the device than in a vicinity of the rear side of the device.

* * * * *